US010240261B2

(12) United States Patent
Sigg

(10) Patent No.: US 10,240,261 B2
(45) Date of Patent: Mar. 26, 2019

(54) SUPPORT OF A FLEXIBLE BEND IN A REVOLVING FLAT CARD

(71) Applicant: Maschinenfabrik Rieter AG, Winterthur (CH)

(72) Inventor: Willi Sigg, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 272 days.

(21) Appl. No.: 15/224,601

(22) Filed: Jul. 31, 2016

(65) Prior Publication Data

US 2017/0029984 A1 Feb. 2, 2017

(30) Foreign Application Priority Data

Jul. 31, 2015 (CH) ..... 1111/15

(51) Int. Cl.
*D01G 15/30* (2006.01)
*D01G 15/28* (2006.01)

(52) U.S. Cl.
CPC ..... *D01G 15/30* (2013.01); *D01G 15/28* (2013.01)

(58) Field of Classification Search
CPC ..... D01G 15/28; D01G 15/30
See application file for complete search history.

(56) References Cited

U.S. PATENT DOCUMENTS 4,298,791 A * 11/1981 Muller ..... G06M 3/021 235/132 R
4,489,496 A * 12/1984 Mizuno ..... G01B 3/22 33/558
4,527,336 A * 7/1985 Mizuno ..... G01B 3/22 33/556
5,186,216 A 2/1993 Bollier
5,625,924 A 5/1997 Sauter et al.
5,845,368 A * 12/1998 Varga ..... D01G 15/28 19/103
5,930,869 A * 8/1999 Faas ..... B01F 3/04475 19/104
2002/0152585 A1* 10/2002 Wust ..... D01G 15/28 19/103

FOREIGN PATENT DOCUMENTS

CN 2 758 281 Y 2/2006
EP 0 484 274 A1 5/1992
EP 1 201 797 A1 5/2002
EP 2 392 703 A1 12/2011

OTHER PUBLICATIONS

Swiss Search Report dated Oct. 21, 2015.

* cited by examiner

*Primary Examiner* — Shaun R Hurley
(74) *Attorney, Agent, or Firm* — Dority & Manning, P.A.

(57) ABSTRACT

A support is provided for a flexible bend in a revolving flat card, the flat card having a cylinder and a cylinder axis. The support has at least three bearing points, with each bearing point comprising a bearing bolt and an adjusting lever. At each bearing point, the flexible bend is held on the bearing bolt such that a rotational motion of the bearing bolt brings about a displacement of the flexible bend radially with respect to the cylinder axis. Each bearing bolt has a bearing bolt axis, a fastening portion, a moving portion, and a contact surface for contact with the flexible bend. The contact surface is formed by a surface that spirals around the bearing bolt axis.

13 Claims, 3 Drawing Sheets

SUPPORT OF A FLEXIBLE BEND IN A REVOLVING FLAT CARD

FIELD OF THE INVENTION

The present invention relates to a support of a flexible bend in a revolving flat card.

BACKGROUND

In a card, the card flats zone in combination with the cylinder forms the main carding area and has the function of opening the tufts to form individual fibers, separating impurities and dust, eliminating very short fibres, opening neps and parallelizing the fibers. Depending on the application of a card, fixed flats, revolving flats, or a mixture of fixed and revolving flats are used in this connection. When revolving flats or a mixture of fixed and revolving flats are used, this is referred to as a revolving flat card. A narrow gap, which is referred to as the carding gap, forms between the card clothings of the flat and the card clothing of the cylinder. This gap forms in the case of revolving flats by the revolving flats being guided by curved strips—so-called "flexible bends", leveling bends, flex bends, or sliding bends—along the cylinder in the circumferential direction at a spacing distance determined by these strips. In a revolving flat card, the size of the carding gap is between 0.10 and 0.30 mm for cotton or up to 0.40 mm for synthetic fibers.

It is known that the flexible bends must be designed so as to be radially displaceable in order to ensure a consistent carding gap along the entire course of the flexible bends. The radial displaceability is necessary for different reasons:

a) For initially setting the carding gap during the production of the card or after a replacement of the cylinder clothing. In this connection, individual bearing points must be adjusted individually in order to provide for a concentric setting of the flexible bends with respect to the cylinder surface.
b) For adjusting the card gap when the card clothings show signs of wear, wherein the objective here is to uniformly adjust all the bearing points.
c) For adjusting the carding gap after the card clothings have been ground.
d) For correcting the carding gap on account of the thermal expansion of the cylinder.
e) For setting the carding gap for different heights of the cylinder or flat clothings depending on the card clothing being used.

In a known device, the flexible bend is fastened on the machine frame using setting screws. The setting screws provide for a concentric setting of the surface of the flexible bend such that the revolving flats can be guided along the cylinder surface with a consistent spacing distance. The positioning accuracy is dependent on the design of the setting screws.

In EP 1 201 797, a device for setting the card gap was proposed, in the case of which the flexible bend is supported on rotatably mounted rollers. The rollers are designed as rotatable, volute cams. When these cams are rotated, as a result of the helical shape, the flexible bend is lifted at the corresponding support point and is moved in the radial direction away from or toward the cylinder axis. In this manner, a rough setting of the carding gap is proposed. For the fine setting, the flexible bend itself is moved in the direction of rotation of the cylinder, which results in a change in the radial spacing distance of the flexible bend from the cylinder axis.

The disadvantage of the device is that the entire flexible bend must be moved in order to set the carding gap. In particular, the fine setting is carried out by moving the flexible bend, which requires a substantial amount of force and, therefore, can only be carried out in abrupt jerking motions.

In EP 2 392 703 A1, a device for setting the card gap was proposed, in which case the flexible bend is held on an eccentrically mounted bolt. The objective in this case is to enable the carding gap to be set without changing the position of the flexible bend in the circumferential direction.

The disadvantage of the disclosed embodiment of the support, however, is the complicated design required for moving the bolt by means of an adjusting device, which is spaced from the bolt, which adjusting device is connected to the bolt via a lever. An additional displacement means is necessary for simultaneously displacing all contact points of the flexible bend, which further complicates the design of the adjusting device.

SUMMARY

An object of the present invention is to create a support of a flexible bend that makes it possible to set the carding gap at a single bearing point and to set the carding gap at all bearing points of the flexible bend at once, wherein the two setting types should utilize the same adjusting element, and wherein it should be possible to adjust a single bearing point without influencing the common adjusting device. Additional objects and advantages of the invention will be set forth in part in the following description, or may be obvious from the description, or may be learned through practice of the invention.

The objects are achieved by the features of the invention described and claimed.

In order to solve the problem, a support of a flexible bend in a revolving flat card comprising a cylinder and a cylinder axis is proposed, wherein the support includes at least three bearing points, each of which has a bearing bolt and an adjusting lever. The flexible bend is held, at each bearing point, on the particular bearing bolt in such a way that a rotational motion of the bearing bolt brings about a displacement of the flexible bend radially with respect to the cylinder axis. The bearing bolt has a bearing bolt axis, a fastening portion, a moving portion, and a contact surface for the contact of the flexible bend, wherein the contact surface is formed by a surface, which spirals around the bearing bolt axis.

Multiple support points, so-called bearing points, are provided for the support of a flexible bend. The number of bearing points is dependent on the design of the flexible bend, in particular on its length. At least three bearing points are necessary for a stable support. The bearing points can be disposed symmetrically or asymmetrically with respect to the flexible bend. However, if the flexible bend is in multiple parts or extends over a relatively large circumference of the cylinder, more than three bearing points, for example, five or seven bearing points, are necessary. In this connection, the flexible bend is supported in such a way that the revolving flats sliding thereon are guided along the cylinder surface in the desired manner.

The flexible bend is held by a bolt at each bearing point. The bolt itself is rotatably fastened in the machine frame of the revolving flat card, wherein the bolt has a fastening portion for this purpose. Advantageously, the fastening portion of the bolt is located at a point where it is adjoined by the moving portion on one side of the fastening portion and by the contact surface for the flexible bend on the other side of the fastening portion. The fastening portion is therefore disposed between the moving portion and the contact surface in the direction of the bearing bolt axis.

In one preferred embodiment, the fastening portion is split by the contact surface disposed within the fastening portion. As a result, the bearing bolt is held at two points in the machine frame, wherein the contact surface for the flexible bend is disposed between these two points. This has the advantage that the bearing points of the bearing bolt are stressed by forces in only one direction and no torques occur. In the case of unilateral support, additional bending forces act on the bearing bolt, which can be avoided by means of a split fastening portion.

The contact surface spirals around the bearing bolt axis. As a result, when the bolt is rotated through a certain angle, the radial spacing distance of the contact surface changes by a certain amount that is dependent on the spiral shape of the contact surface. Due to the spiral shape, the usable contact surface does not extend along the entire circumference of the bearing bolt. In order to set the carding gap, it is sufficient if the spacing distance of the flexible bends from the cylinder axis can be changed in a range from 2 to 10 mm. This change in the radial spacing distance of the flexible bend from the cylinder axis corresponds to the necessary change in the spacing distance of the contact surface from the bearing bolt axis. As a result of the spiral shape, the spacing distance of the contact surface from the bearing bolt axis likewise changes by 2 mm to 10 mm. In this connection, the spiral shape is positioned in such a way, for example, that the change in the spacing distance results during at least one-half of the circumference of the bearing bolt. The radial spacing distance of the contact surface from the bearing bolt axis therefore changes, for example, by an amount from 2 mm to 10 mm during one rotation of the bearing bolt through 180°. Preferably, the objective should be to change the spacing distance from 4 mm to 8 mm, and a change of 6 mm in the spacing distance has proven to be particularly advantageous.

In order to provide for simple installation, care should be taken, advantageously, to ensure that the contact surface has a maximum radial spacing distance from the bearing bolt axis that is not greater than one-half the diameter of the bearing bolt at its fastening portion.

In one preferred embodiment, the spiral shape of the contact surface is an Archimedean spiral. As a result, a decrease or an increase in the spacing distance of the contact surface from the bearing bolt axis during a rotation of the bearing bolt is linear with respect to the rotational angle. An Archimedean spiral has a continuous slope. This has the advantage that the rotation of the bearing bolt through a certain angle always effectuates the same change in the radial spacing distance of the contact surface, independently of the position of the bearing bolt. The radial spacing distance (B) of the contact surface from the bearing bolt axis is therefore defined as $B=k\times(\alpha+\beta)$, wherein k is a constant, $\alpha$ is the rotational angle of the bearing bolt, and $\beta$ is the angle between the contact point and the movement line of the flexible bend. If the contact of the flexible bend on the contact surface consists of a linear contact, the angle $\beta$ between the contact point and the movement line of the flexible bend becomes zero.

Given that the flexible bend has a support surface, however, on a side facing the contact surface of the bearing bolt, which support surface is designed as a plane, the flexible bend rests tangentially on the helical contact surface of the bearing bolt. The movement line, along which the displacement of the flexible bend takes place as a result of the rotation of the bearing bolt, is therefore not identical to the line perpendicular to the tangent on which the flexible bend rests. The line perpendicular to the tangent of the contact point of the flexible bend is positioned at a certain angle with respect to the displacement line along which the flexible bend is displaced via the rotation of the bearing bolt. In order to account for this situation, in a particularly preferred embodiment, the helical shape of the contact surface of the bearing bolt should be provided in such a way that, despite the difference between the contact point of the flexible bend on the bearing bolt and the movement line, there is a linear dependence between the rotational angle of the bearing bolt and the spacing distance (A) between the bearing bolt axis and the flexible bend in the direction of movement of the flexible bend. The spacing distance (A) of the contact point of the flexible bend on the contact surface of the bearing bolt parallel to the movement line of the flexible bend is therefore defined as $A=k\times\alpha$, wherein k is a constant and a is the rotational angle of the bearing bolt.

In one preferred embodiment, the adjusting lever is held on the moving portion of the bearing bolt. In this connection, the adjusting lever is non-rotatably held on the bearing bolt by means of a releasable locking mechanism. The locking mechanism comprises a fixing screw and a two-pieced clamping bolt. As a result of the clamping bolt being drawn together by means of the fixing screw, the bearing bolt is held in the adjusting lever in a force-locked manner via the clamping bolt. The shape of the clamping bolt along its longitudinal axis is matched to the shape of the bearing bolt, at least on one side. If the two halves of the clamping bolt are now drawn together, this effectuates a tightening of the clamping bolt against the bearing bolt. It is also conceivable, instead of a clamping bolt, to design a part of the displacement lever so as to be elastic. By means of a fixing screw, this elastic part of the adjusting lever can be subsequently pressed against the bearing bolt and bring about a fixation of the adjusting lever on the bearing bolt.

In order to enable a basic setting or a change in every single bearing point of the flexible bend to be implemented, a device is provided that permits a rotation of the bearing bolt independently of the adjusting lever and independently of the other bearing points. For this purpose, it is provided in one advantageous embodiment that the moving portion of the bearing bolt is provided with a tooth system on at least a portion of its circumference. Furthermore, an adjusting element is provided in the adjusting lever, which, in combination with the tooth system on the circumference of the bearing bolt, forms a reduction stage (such as a worm gear, for example). By means of the adjusting element, the bearing bolt can therefore be set into rotation via the reduction stage and, therefore, the flexible bend can be brought into the desired basic position. Since the displacement of the flexible bend has a linear relationship with the angle of rotation of the bearing bolt, and the rotational angle of the bearing bolt likewise has a predefined relationship with the angle of rotation of the adjusting element, then, due to the reduction stage, a precise and predictable displacement of the flexible bend can take place. In order to rotate the adjusting element, it can be provided with a coupling piece appropriate for a certain tool, which coupling piece can be, for example, a hexagon head, a hexagon socket, or any other type of known, non-rotatable coupling associated with the use of hand tools. After an individual basic setting of a bearing point is achieved, the adjusting lever is non-rotatably connected to the adjusting lever by means of the locking mechanism.

Given that the contact surface of the bearing bolt effectuates a displacement of the flexible bend that is dependent only upon the rotational angle of the bearing bolt, it does not matter which individual position the helical contact surface of the bearing bolt is currently located in at each bearing point. A further rotation of the bearing bolt always results in a displacement of the flexible bend acting linearly with respect to the rotational angle.

The adjusting levers of the individual bearing points are connected to a common slider. As a result of this connection, the adjusting lever and, via the locking mechanism, also the bearing bolt are non-rotatably held. The hold of the adjusting lever in the slider is implemented via a radially oriented guide groove disposed in the slider. For this purpose, a guide pin is provided on the adjusting lever, which guide pin engages into the guide groove. If the slider is then moved tangentially with respect to the cylinder axis, this movement is transferred, via the guide pins, to the adjusting lever and results in a rotation of the adjusting lever about the bearing bolt axis. As a result of the locking of the adjusting lever on the bearing bolt, the rotation of the adjusting lever is transferred to the bearing bolt. As a result, due to the rotation of the bearing bolts, the flexible bend is radially displaced in all bearing points simultaneously and, due to the helical contact surface of the bearing bolts, said flexible bend is radially displaced by the same amount in all bearing points. In this connection, the displacement is independent of the current individual setting of the individual bearing points.

In a further-reaching embodiment, the slider is provided with a drive. This provides for an automatic displacement of the flexible bend by means of a central controller. In this connection, the tangential movement of the slider is in a fixed relationship with the displacement of the flexible bend. The movement of the slider is transmitted by means of the adjusting lever and the helical contact surface of the bearing bolt, whereby a large movement of the slider results in a small displacement of the flexible bend. This provides for a high level of accuracy in the displacement of the flexible bend in increments of less than 0.01 mm.

If the drive of the slider is connected to a controller, which itself is connected to a known measuring device for determining the carding gap, a card flat actuator system can be operated with the aid of the slider. A card flat actuator system is used for automatically setting the carding gap between the revolving flats and the cylinder of a card. If the card clothings of the cylinder or the card clothings of the revolving flats are re-ground, for example, this change in the carding gap is determined by the controller via the measuring device and is automatically compensated for by means of the slider.

BRIEF DESCRIPTION OF THE DRAWINGS

The invention is described in greater detail in the following on the basis of exemplary embodiments and with reference to drawings.

DETAILED DESCRIPTION

Figure 1:
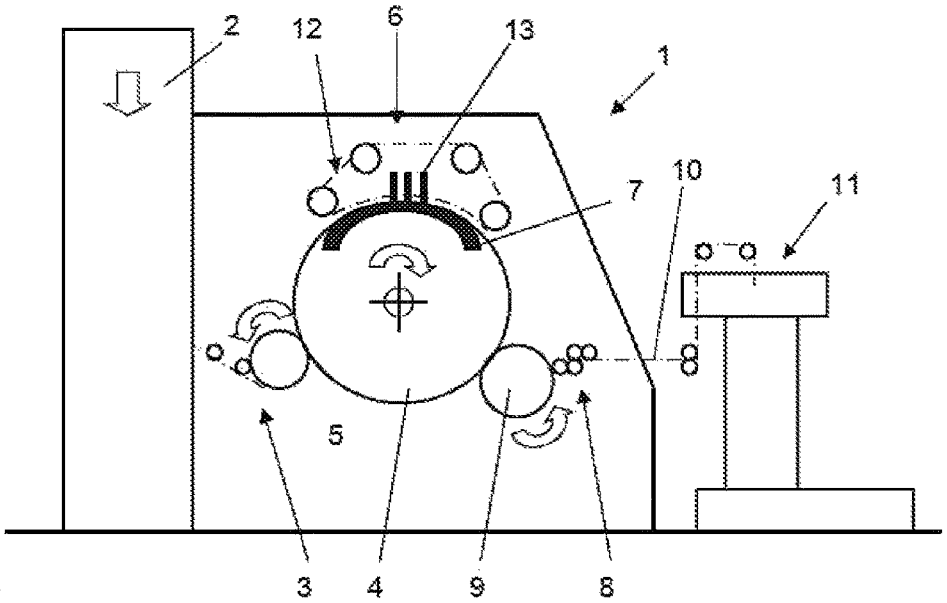
Fig. 1 (Prior Art)
FIG. 1 shows a schematic illustration of a side view of a revolving flat card according to the prior art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A known revolving flat card 1 is illustrated in FIG. 1, wherein tufts are fed from a feed chute 2 to a fiber feed device 3 and a downstream cylinder 4. The revolving flat card 1 comprises a single cylinder 4 (main cylinder or so-called cylinder), which is rotatably supported in a machine frame 5. The cylinder 4 interacts, in a known manner, with a revolving flat assembly 6, a fiber feed device 3, and a fiber removal system 8, wherein the latter comprises, in particular, a so-called doffer 9. Carding elements and fiber-routing elements, which are not shown in greater detail here, can be disposed between the revolving flat arrangement 6, the fiber feed device 3, and the fiber removal system 8. The fiber removal system 8 conveys the sliver 10 to a schematically indicated sliver coiling system 11.

A plurality of revolving cards 13 is provided at the aforementioned revolving flat assembly 6, wherein only a single revolving card 13 is schematically depicted in FIG. 1. Revolving flat assemblies 6 that are common today comprise multiple, narrowly spaced revolving flats 13, which revolve. For this purpose, the revolving flats 13 are carried, near their respective end faces, by endless belts 12 and are moved counter to or in the direction of rotation of the cylinder 4. The support takes place, in this connection, on flexible bends 7 on the underside of the revolving flat assembly 6. The revolving flats 13 slide on the flexible bend 7 as they are guided along the cylinder surface.

Figure 2:
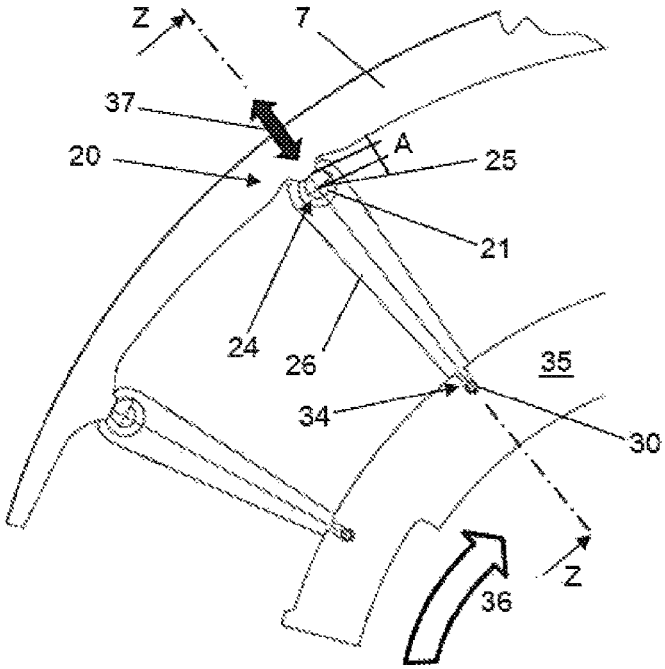
FIG. 2 shows a schematic illustration of one view of an embodiment of a bearing point according to the invention.

FIG. 2 shows a schematic illustration of one embodiment of a bearing point 20 of a flexible bend 7 according to the invention. The flexible bend 7 is shown in a sectional view and is supported on multiple bearing points 20. At the bearing point 20, the flexible bend 7 is held on a bearing bolt 21. The bearing bolt 21 is shown in a sectional view such that the contact surface 24, on which the flexible bend 20 rests, is shown. The contact surface 24 of the bearing bolt 21 spirals around the bearing bolt axis 25. The bearing bolt axis 25 is the rotational axis of the bearing bolt 21. The bearing bolt 21 is rotatably mounted in the machine frame (not shown), and so the rotational axis, or the bearing bolt axis 25, is held stationary. The adjusting lever 26 is non-rotatably held on the bearing bolt 21. In turn, the adjusting lever 26 is held, by means of a guide pin 30, in a guide groove 34 of a slider 35.

In the event of a tangential movement 36 of the slider 35, all the adjusting levers 26 are rotated by means of their guide pins 34 about the bearing bolt axis 25. Since the adjusting lever 26 is also non-rotatably connected to the bearing bolt 21, the rotational motion of the adjusting lever 26 is transferred to the bearing bolt 21. As a result of the rotational motion of the bearing bolt 21, the spacing distance A of the flexible bend 7 from the bearing bolt axis 25 changes due to the helical contact surface 24 of the bearing bolt. Since the bearing bolt 21 and, therefore, the bearing bolt axis 25 are held stationary in the machine frame, the flexible bend 7 is moved radially away from the bearing bolt axis 25 or toward the bearing bolt axis 25. The direction of movement 37 of the flexible bend 7 is dependent on the rotational direction of the bearing bolt 21 and the arrangement of the helical contact surface 24.

Figure 3:
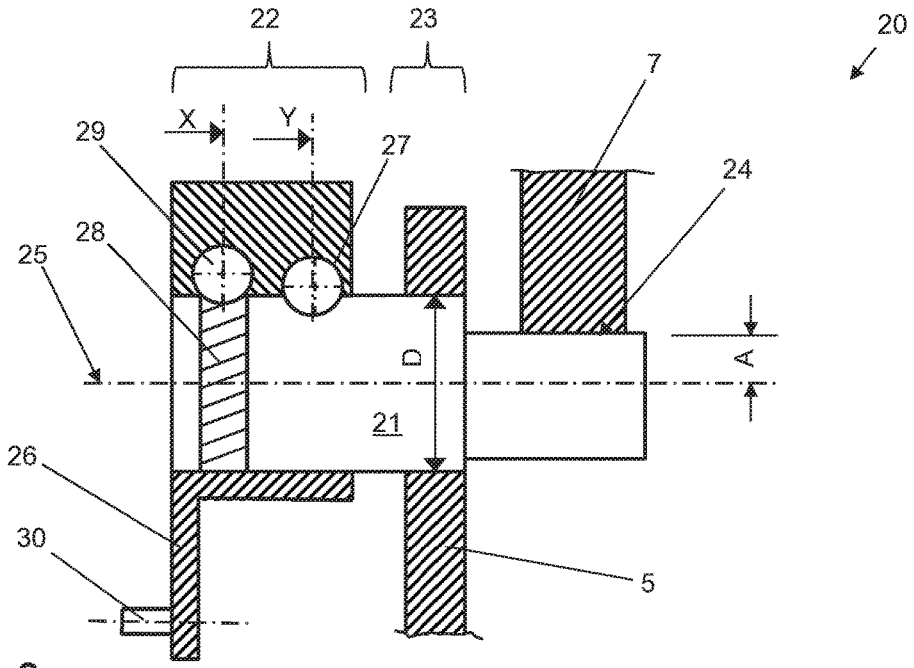
FIG. 3 shows a schematic sectional illustration of one embodiment at the point Z-Z according to FIG. 2.

FIG. 3 shows a schematic sectional illustration at the point Z-Z according to FIG. 2 of a view of an embodiment of a bearing point 20 according to the invention. The bearing bolt 21 has a moving portion 22, a fastening portion 23, and a contact surface 24. The flexible bend 7 is supported on the contact surface 24, which has a position-dependent spacing distance A from the bearing bolt axis 25. In the fastening portion 23, the bearing bolt 21 is rotatably mounted in the machine frame 5. In the fastening portion 23, the bearing bolt 21 has a diameter D, which corresponds to at least twice the largest possible spacing distance B of the contact surface 24 from the bearing bolt axis 25 (for the largest possible spacing distance $B_{max}$, see FIG. 7). An adjusting lever 26 is disposed in the moving portion 22 of the bearing bolt 21. The adjusting lever 26 is non-rotatably connected to the bearing bolt 21 by means of the locking mechanism 27. At least part of the bearing bolt 21 is provided with a tooth system 28 in the moving portion 22. The adjusting element 29 installed in the adjusting lever 26 engages into this tooth system 28. A guide pin 30 mounted on the adjusting lever 26 is provided for non-rotatably holding the adjusting lever 26. The guide pin 30 is held by the slider 35 (see FIG. 2). When the locking mechanism 27 is released, the adjusting element 29 can be rotated in order to rotate the bearing bolt 21 via the tooth system 28 for manually setting the basic spacing distance A of the contact surface 24 from the bearing bolt axis 25. After the manual basic setting of the bearing point 20, the locking mechanism 27 is engaged and any further displacement of the bearing point 20 is carried out by rotating the adjusting lever 26. The rotation of the adjusting lever 26 is transferred via the locking mechanism 27 directly to the bearing bolt 21.

Figure 4:
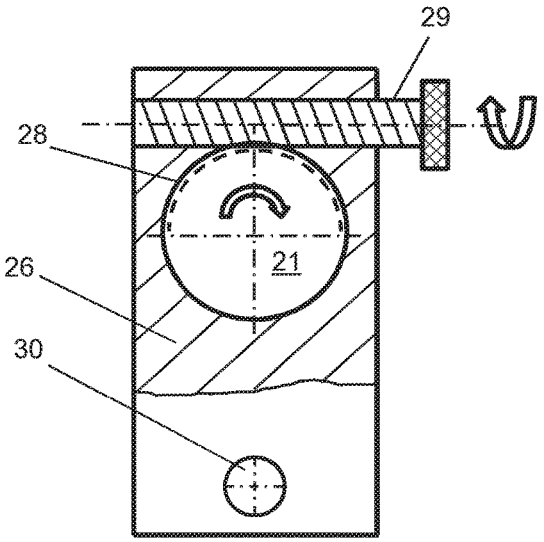
FIG. 4 shows a schematic sectional illustration at the point X according to FIG. 3.

FIG. 4 shows a schematic sectional illustration at the point X according to FIG. 3. The moving portion 22 of the bearing bolt 21 is shown at the point having the tooth system 28. The tooth system 28 extends over only a portion of the circumference of the bearing bolt 21, specifically over a portion of the circumference that corresponds to the helical shape of the contact surface of the bearing bolt 21. The adjusting element 29 mounted in the adjusting lever 26 engages, via its worm gear, into the tooth system 28, which induces a rotation of the bearing bolt 21 when the adjusting element 29 is rotated. The adjusting lever 26 is prevented from rotating by the guide pin 30. The adjusting element 29 is provided with a head, which is designed for use with a tool or which can be operated by hand.

Figure 5:
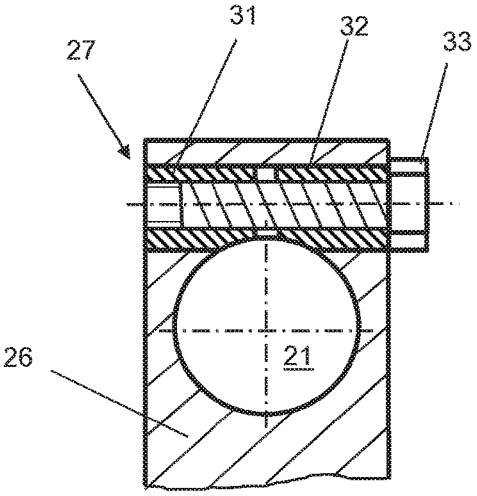
FIG. 5 shows a schematic sectional illustration at the point Y according to FIG. 3.

FIG. 5 shows a schematic sectional illustration at the point Y according to FIG. 3. The moving portion 22 of the bearing bolt 21 is shown at the point having the locking mechanism 27 of the adjusting lever 26. The locking mechanism 27 consists of two clamping bolt halves 31, 32, which are inserted into a hole in the adjusting lever 26. In this case, a first clamping bolt half 31 is introduced from one side of the bearing bolt 21 and a second clamping bolt half 32 is introduced from the opposite side of the bearing bolt 21 into the hole in the adjusting lever 26. The two clamping bolt halves 31, 32 are drawn together by means of a fixing screw 33, whereby the first clamping bolt half 31 is provided with a corresponding inner thread. The two clamping bolt halves 31, 32, in the area of the bearing bolt 21, are provided with a shape corresponding to the bearing bolt, and so drawing the clamping bolt halves 31, 32 together causes the adjusting lever 26 to be non-rotatably held on the bearing bolt 21. The same effect could also be achieved by designing one side of the adjusting lever 26 so as to be elastic and drawing the elastic area of the adjusting lever 26 together with the rigid area of the adjusting lever 26 by means of the fixing screw 33 and thereby non-rotatably connecting the adjusting lever 26 to the bearing bolt 21.

Figure 6:
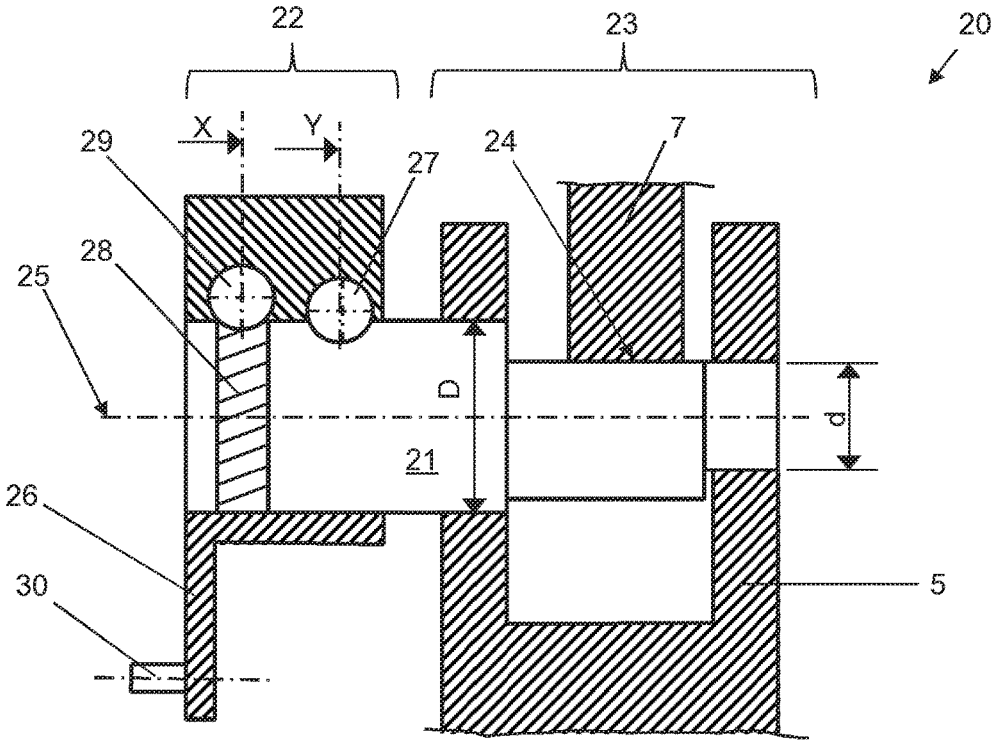
FIG. 6 shows a schematic sectional illustration of another embodiment at the point Z-Z according to FIG. 2.

FIG. 6 shows a schematic sectional illustration of another embodiment, at the point Z-Z according to FIG. 2, of a bearing point 20. In contrast to the embodiment according to FIG. 3, the contact surface 24 of the bearing bolt 21 is disposed within the fastening portion 23. The fastening portion 23 adjoins the moving portion 22 and is interrupted by the contact surface 24. The diameter D of the bearing bolt 21, on the side facing the moving portion 22, corresponds to the diameter D according to FIG. 3. On the side of the fastening portion facing away from the moving portion 22, however, the bearing bolt 21 has a smaller diameter d, which is less than twice the minimum spacing distance $B_{min}$ of the contact surface 24 from the bearing bolt axis (see FIG. 7). The design of the moving portion 22 having the adjusting lever 26 corresponds to the embodiment according to FIG. 3. An adjusting lever 26 is disposed in the moving portion 22 of the bearing bolt 21. The adjusting lever 26 is non-rotatably connected to the bearing bolt 21 via the locking mechanism 27. At least part of the bearing bolt 21 is provided with a tooth system 28 in the moving portion 22. The adjusting element 29 installed in the adjusting lever 26 engages into this tooth system 28. A guide pin 30 mounted on the adjusting lever 26 is provided for non-rotatably holding the adjusting lever 26. The bearing bolt 21 is mounted, via its fastening portion 23, in the machine frame 5 on both sides of the contact surface 24. As a result, the forces applied by the flexible bend 7 onto the bearing bolts 21 in two support positions are absorbed by the machine frame 5 and the bending stress of the bearing bolt 21 is reduced as compared to the embodiment according to FIG. 3.

Figure 7:
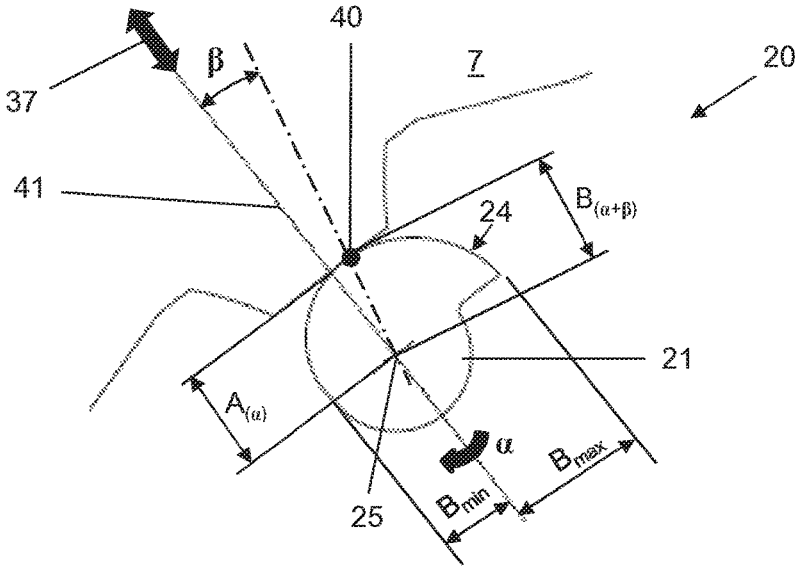
FIG. 7 shows a schematic illustration of one embodiment of a bearing point.

FIG. 7 shows a schematic illustration of a bearing point 20. The bearing bolt 21 having the helical contact surface 24 is rotatably held in the machine frame, being stationary in its bearing bolt axis 25. The flexible bend 7 rests with its support surface, which is designed as a plane, tangentially on the contact surface 24 of the bearing bolt 21. This contact point 40 determines the spacing distance $B_{(\alpha+\beta)}$ of the contact surface 24 from the bearing bolt axis 25 measured in a plane rotated through the angle β with respect to the moving direction 37 of the flexible bend. This spacing distance $B_{(\alpha+\beta)}$ of the flexible bend 7 from the bearing bolt axis 25 is not the same, however, as the radial spacing distance $A_{(\alpha)}$ of the contact surface 24 from the bearing bolt axis 25 in the moving direction 37 of the flexible bend 7. Given that the flexible bend 7 has a support surface on a side facing the contact surface 24 of the bearing bolt 21, which support surface is designed as a plane, the flexible bend 7 rests tangentially on the helical contact surface 24 of the bearing bolt 21 on the contact point 40. The contact point 40 of the flexible bend 7 is rotated through an angle β with respect to the movement line 41 of the flexible bend 7. The helical contact surface 24 of the bearing bolt 21 is shaped in such a way that, upon rotation of the bearing bolt 21, the spacing distance $A_{(\alpha)}$ of the flexible bend 7 changes by an amount that is linearly dependent on the rotational angle α. Therefore, when the rotational angle α changes, the change in the spacing distance $A_{(\alpha)}$ is a multiple of a constant.

According to FIG. 7, the helical contact surface 24 extends over one-half the circumference of the bearing bolt 21. This results in a minimum spacing distance $B_{(\alpha+\beta)}$ which is $B_{min}$ and a maximum spacing distance $B_{(\alpha+\beta)}$ which is $B_{max}$. The difference of $B_{min}$ and $B_{max}$ yields the maximum possible displacement of the flexible bend 7 on its movement line 41.

Modifications and variations can be made to the embodiments illustrated or described herein without departing from the scope and spirit of the invention as set forth in the appended claims.

LEGEND

1 revolving flat card
2 feed chute
3 fiber feed device
4 cylinder
5 machine frame
6 revolving flat assembly
7 flexible bend
8 fiber removal system
9 doffer
10 sliver
11 sliver coiling system
12 endless belt
13 revolving flat
20 bearing point
21 bearing bolt
22 moving portion
23 fastening portion
24 contact surface
25 bearing bolt axis
26 adjusting lever
27 locking mechanism
28 tooth system
29 adjusting element
30 guide pin
31, 32 clamping bolt halves
33 fixing screw
34 guide groove
35 slider
36 tangential movement of the slider
37 direction of movement of the flexible bend
40 contact point
41 movement line of the flexible bend
$A_{(\alpha)}$ spacing distance of the flexible bend from the bearing bolt axis
$B_{(\alpha+\beta)}$ radial spacing distance of the contact surface from the bearing bolt axis
$B_{max}$ maximum spacing distance B
$B_{min}$ minimum spacing distance B
D first diameter of the bearing bolt in the fastening portion
d second diameter of the bearing bolt in the fastening portion
$\alpha$ rotational angle of the bearing bolt
$\beta$ angle between the contact point and the movement line of the flexible bend

The invention claimed is:

1. A support for a flexible bend in a revolving flat card, the flat card having a cylinder and a cylinder axis, the support comprising:

at least three bearing points, each bearing point further comprising a bearing bolt and an adjusting lever, wherein at each bearing point, the flexible bend is held on the bearing bolt such that a rotational motion of the bearing bolt brings about a displacement of the flexible bend radially with respect to the cylinder axis;

each bearing bolt comprising a bearing bolt axis, a fastening portion, a moving portion, and a contact surface for contact with the flexible bend;

wherein the contact surface is formed by a surface that spirals around the bearing bolt axis; and wherein the adjusting lever is held on the moving portion of each of the bearing bolts, and wherein all of the adjusting levers are connected to a common slider.

2. The support according to claim 1, wherein the spiral surface is an Archimedean spiral and, therefore, a decrease or an increase in a radial spacing distance (B) of the contact surface from the bearing bolt axis during a rotation of the bearing bolt is linear with respect to a rotational angle of the bearing bolt.

3. The support according to claim 1, wherein the spiral surface is defined such that there is a linear dependence between a rotational angle ($\alpha$) of the bearing bolt and a spacing distance (A) between the bearing bolt axis and the flexible bend in the direction of movement of the flexible bend.

4. The support according to claim 1, wherein a radial spacing distance (B) of the contact surface from the bearing bolt axis decreases or increases by 5% to 30% in a helical manner along a course of the contact surface during at least one-half of a circumference of the bearing bolt.

5. The support according to claim 1, wherein the fastening portion is disposed between the moving portion and the contact surface in the direction of the bearing bolt axis (25).

6. The support according to claim 5, wherein the fastening portion is split by the contact surface disposed within the fastening portion.

7. The support according to claim 1, wherein the adjusting lever is non-rotatably held on the bearing bolt by a releasable locking mechanism.

8. The support according to claim 1, wherein at least part of a circumference of the moving portion of the bearing bolt is provided with a tooth system.

9. The support according to claim 8, further comprising an adjusting element configured with the adjusting lever, the adjusting element in combination with the tooth system forming a worm gear.

10. The support according to claim 1, wherein the contact surface has a maximum radial spacing distance (Bmax) from the bearing bolt axis (25) that is not greater than one-half the diameter (D) of the bearing bolt at the fastening portion.

11. The support according to claim 1, wherein each adjusting lever is held by a guide pin in the slider in a radially oriented guide groove.

12. The support according to claim 1, wherein the slider is provided with a drive.

13. A revolving flat card, comprising:

a cylinder having cylinder clothing thereon;

a revolving flat assembly comprising a plurality of interconnected revolving flats guided on a flexible bend; and a support for the flexible bend according to claim 1.

* * * * *